US008550264B2

(12) United States Patent
Langtry et al.

(10) Patent No.: US 8,550,264 B2
(45) Date of Patent: Oct. 8, 2013

(54) INCLINED DISPLAY SHELVES AND ACCESSORIES THEREFOR

(75) Inventors: David Langtry, New Westminster (CA); William G. Steed, New Westminster (CA); David Langtry, legal representative, New Westminster (CA)

(73) Assignee: Patent Applied Technology, Burnaby, B.C. (CA)

( * ) Notice: Subject to any disclaimer, the term of this patent is extended or adjusted under 35 U.S.C. 154(b) by 0 days.

(21) Appl. No.: 13/208,053

(22) Filed: Aug. 11, 2011

(65) Prior Publication Data

US 2012/0061289 A1 Mar. 15, 2012

Related U.S. Application Data

(63) Continuation-in-part of application No. 12/880,501, filed on Sep. 13, 2010, now abandoned.

(51) Int. Cl.
*A47F 5/08* (2006.01)
*B65D 1/34* (2006.01)

(52) U.S. Cl.
USPC ..... 211/88.01; 206/557; 211/90.01

(58) Field of Classification Search
USPC ..... 206/216, 459.5, 731, 735, 557; 211/55, 211/134, 153, 88.01, 90.01, 90.03, 90.04, 211/133.1; 229/112; 414/276, 286
See application file for complete search history.

(56) References Cited

U.S. PATENT DOCUMENTS

| | | | | | |
|---|---|---|---|---|---|
| 1,875,781 | A | * | 9/1932 | Turner | 229/112 |
| 2,142,883 | A | * | 1/1939 | Chaney et al. | 206/738 |
| 2,796,978 | A | * | 6/1957 | Struble | 206/743 |
| 2,950,833 | A | | 8/1960 | Short | |
| 4,761,081 | A | | 8/1988 | Mulford | |
| 5,318,187 | A | * | 6/1994 | Rosenthal | 211/88.01 |
| 5,482,422 | A | | 1/1996 | Hammond | |
| 5,836,455 | A | * | 11/1998 | Connor et al. | 206/757 |
| D426,772 | S | | 6/2000 | Kahl | |
| 6,378,710 | B1 | * | 4/2002 | Grueneberg | 211/132.1 |
| 6,427,907 | B1 | * | 8/2002 | Espinoza et al. | 229/122 |
| 6,799,689 | B2 | | 10/2004 | Langtry | |
| 2007/0090011 | A1 | * | 4/2007 | Ballestrazzi et al. | 206/459.5 |
| 2007/0295681 | A1 | * | 12/2007 | Colin | 211/90.03 |

FOREIGN PATENT DOCUMENTS

| | | |
|---|---|---|
| CA | 2453273 | 11/2008 |
| JP | 59012002 | 1/1984 |

* cited by examiner

*Primary Examiner* — Luan K Bui
(74) *Attorney, Agent, or Firm* — Adrian D. Battison; Ade & Company, Inc.

(57) ABSTRACT

Containers are mounted in rows on a display rack having shelves inclined upwardly so that articles on the shelf tend to slide forwardly. The containers arranged in rows located side by side across the width of the shelf are formed of board or as transparent plastic jars. Each container has a base on the shelf, upstanding front and rear walls and upstanding side walls with the front and rear walls inclined at a wall angle to a plane at right angles to the base the base so that with the base sitting on the inclined shelf the front and rear walls stand substantially upright. The front wall is higher than the rear wall to provide an exposed strip of each container of the row so that all strips can be seen in front elevation. The strip can be marked with a bar code.

18 Claims, 6 Drawing Sheets

INCLINED DISPLAY SHELVES AND ACCESSORIES THEREFOR

This application is a continuation in part application of application Ser. No. 12/880501 filed Sep. 13, 2010, now abandoned.

This invention relates to inclined display shelves and accessories therefore which allow the better display of products for sale on display shelves of the inclined self feeding type.

BACKGROUND OF THE INVENTION

Racks to hold and display packaged products in the fastener industry are known, both with horizontal and sloped or angled shelves. Shelves that are angled downwards or toward the viewer or customer are also known, and are designed in this manner to allow the remaining boxes or packages to slide forward as the first container in the row is removed by a worker or customer.

Carton flow racks of this type provide excellent storage density combined with picking efficiency. No power source is required, and because frontage per item is greatly reduced, restocking and picking can be done much faster. In fact, one person can do the work of three or four. Typically static shelving: pickers spend only 15% of their time doing productive work. It has been found that with gravity carton flow, pickers spend 85% of their time doing productive work. A gravity carton flow system may cost a little more than conventional shelving but it cuts labor costs drastically. This type of racking is commonly used by retailers such as Home Depot and Lowes. Examples of a system which allows the gravity flow system to be allied to conventional shelving frame work is shown in Canadian Patent 2453273 entitled SHELVING DISPLAY RACK which corresponds to U.S. Pat. No. 6,799,689.

Products for shelving of this type are commonly packaged in square or rectangular shaped boxes or containers to be place on the shelf. In some cases, heavily loaded boxes may bind or stick to the shelf material thus preventing the self feeding system form operating.

SUMMARY OF THE INVENTION

It is one object of the invention to provide an arrangement of containers for the rack which will assist with displaying the products contained on the inclined shelf.

According to one aspect of the invention there is provided a set of containers for use with a display rack having a plurality of shelves where at least some of the shelves are inclined at a shelf angle from a front edge upwardly and rearwardly to a rear edge so that articles on the shelf tend to slide forwardly to the front edge, the set of containers comprising:

a plurality of containers each having a base for resting on the shelf, upstanding front and rear walls and upstanding side walls;

the front, rear and side walls of the containers defining a common width and depth of the containers so that they can be arranged in rows located side by side across the width of the shelf with a plurality of containers in each row from the front edge to the rear edge;

the containers having the front and rear walls inclined at a wall angle to a plane at right angles to the base the base, which wall angle is substantially equal to the shelf angle so that with the base sitting on the inclined shelf the front and rear walls stand substantially upright.

Preferably each container has a front wall which extends from the base to a top edge which is higher than a top edge of the rear wall thereof.

Preferably a portion of the front wall at the top edge of the front wall is exposed above the top edge of the rear wall of the next adjacent container of the row.

Preferably the exposed portion forms a strip at the top edge.

Preferably each container of the row has the portion thereof exposed.

Preferably, when viewed in front elevation, the portions of the containers of the row are visible each behind the next.

Preferably the portions of the containers of the row contain product data printed thereon.

Preferably the product data comprises a machine readable code.

Preferably the front and rear walls are planar and parallel and the side walls are planar and parallel so that the containers are substantially rectangular.

Preferably the containers are formed of a board material.

Preferably the front wall includes an opening covered by a transparent material to allow viewing of the contents.

Preferably the walls are molded from a transparent material.

Preferably there is provided a tray with a flat base arranged to sit on the shelf with front and rear walls upstanding from the base, the tray having a width substantially equal to the width of the containers for receiving one row of the containers.

Preferably the tray includes a removable cover portion for retaining the containers on the tray and protecting the containers for shipping, the cover portion being removable to allow the tray containing the containers to be placed on the shelf for display of the containers.

Preferably the tray has at least the base thereof formed from a plastics material having a coefficient of friction less than that of the shelf.

The arrangement described in more detail hereinafter provides boxes and containers specifically designed to suit sloped rack shelves. The container shapes lend themselves to the larger type of racking The arrangement described in more detail hereinafter also provides a sleeve or tray beneath the boxes or packages carried by the shelf. This sleeve or tray should be manufactured from a material known to have a low coefficient of friction. Numerous types of plastic with suitable characteristics are available. This type of sleeve or tray has the added benefit of being usable as a shipping container for several packages or boxes.

The arrangement described in more detail hereinafter also provides a plastic container or jar which has been modified for use in the sloped rack system.

The arrangement described in more detail hereinafter also provides lids for the jars which are provided with openings to allow easy removal of contained product without removing the lid from the container. The opening provided may encompass one half or more of the top surface area of the lid. The opening portion of the lid is provided with four or more protrusions to form "clips" in order to hold a tool to set or imbed the product when the product is one such as finishing nails. The protrusions may also hold a tool known as a "driver bit" when the product held by the container is a type of screw which uses a tool to apply it. The lid, when in a closed position, is retained by one or more protrusions forming a latch which are in frictional contact with the main body of the lid.

When applied to the arrangements shown in Patents Canadian patent 2453273 and U.S. Pat. No. 6,799,689 related to larger pallet carrying racks, the self feeding characteristics greatly reduce labour for warehouse staff who would normally be required to pull remaining boxes and packages forward.

Advantages of the modified container system combined with sloped rack shelves are as follows:

The use of packages or containers shaped to suit the angled or sloped racks improves the ability of remaining packages to slide forward and downward as one is removed from the rack, presenting an orderly and attractive presentation of product to the customer.

The use of boxes or containers modified in this manner is more attractive to the customer.

The tendency for boxes and containers to align themselves at the front of the display reduces time spent by staff in keeping displays orderly.

Product counts are simplified because all boxes or packaged items are at the front of the rack.

BRIEF DESCRIPTION OF THE DRAWINGS

One embodiment of the invention will now be described in conjunction with the accompanying drawings in which:

FIGS. 7C and 7B are side elevational views of the lid of FIGS. 7A and 7B.

In the drawings like characters of reference indicate corresponding parts in the different figures.

DETAILED DESCRIPTION

Figure 1:
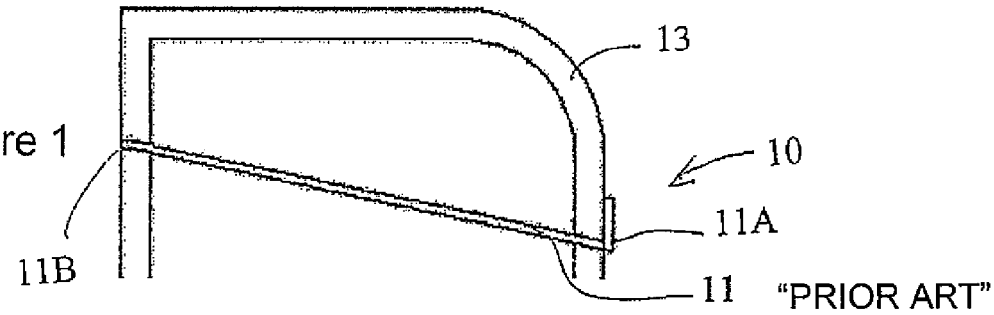
FIG. 1 is a side elevational view of one example of a conventional shelving rack with angled or sloped shelves.
Figure 2:
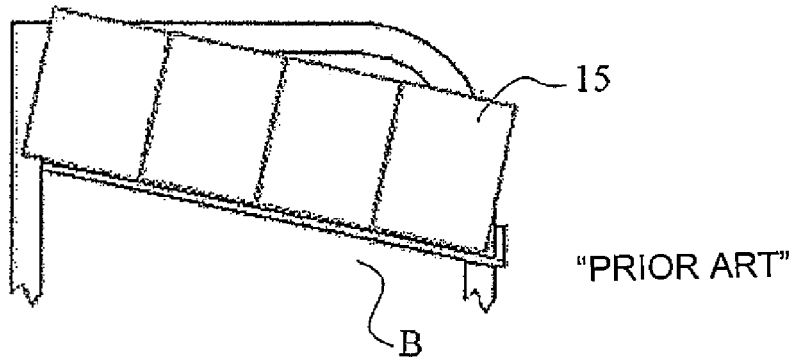
FIG. 2 is a side elevational view of the same conventional shelf of the rack of FIG. 1 with square or rectangular product container boxes placed on it.

FIGS. 1 and 2 show a conventional display rack which can be of the type shown in the above patent. In FIG. 2 the containers 15 for the articles to be sold are of the conventional type typically used with such racks. The containers 15 are arranged in a series of rows side by side across the shelf. The display rack 10 has a plurality of shelves 11 where at least some of the shelves 11 are inclined at a shelf angle B from a front edge 11A upwardly and rearwardly to a rear edge 11B so that articles on the shelf tend to slide forwardly to the front edge. The shelves are mounted on a frame system 13 of a conventional construction.

Figure 3:
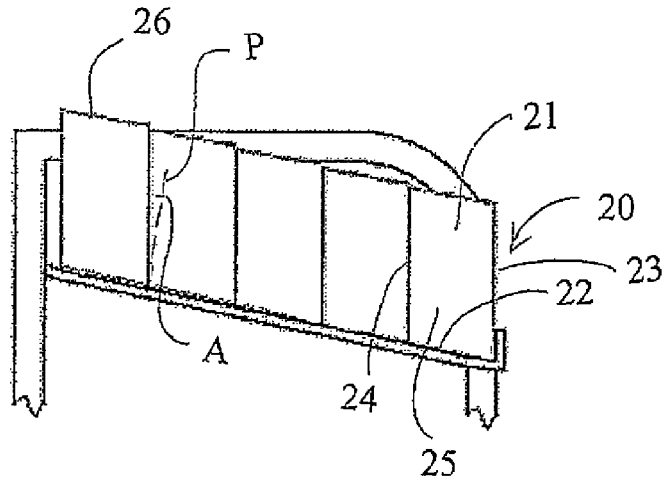
FIG. 3 is a side elevational view of the same conventional shelf of the rack of FIG. 1 with modified product container boxes according to the present invention placed on it.
Figure 5:
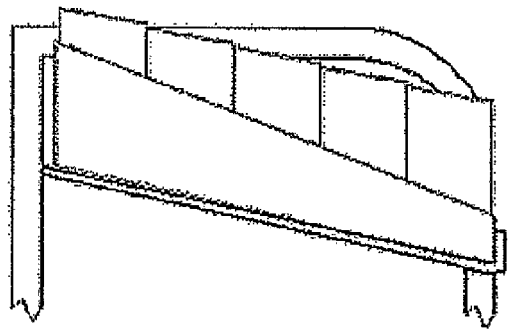
FIG. 5 is a side elevational view of the same conventional shelf of the rack of FIG. 1 with modified product container boxes of FIG. 3 and a slide container or tray according to the present invention placed on the shelf and containing the boxes of FIG. 3.
Figure 4A:
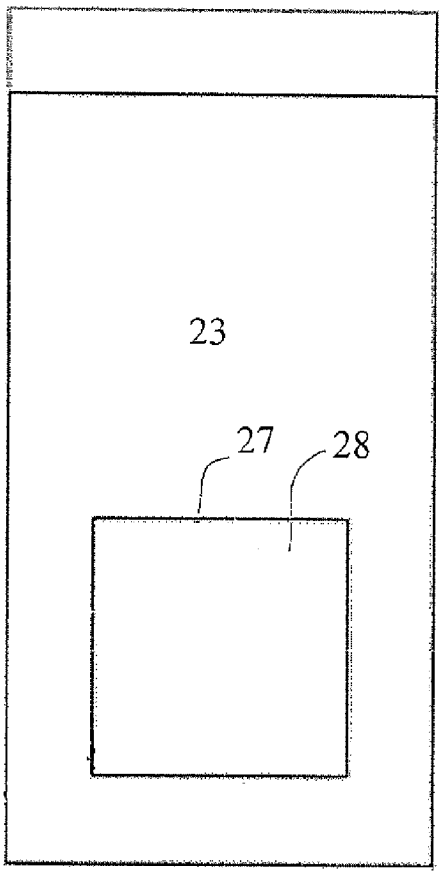
FIGS. 4A and 4B are respectively front and side views of the modified product container boxes of FIG. 3.
Figure 4B:
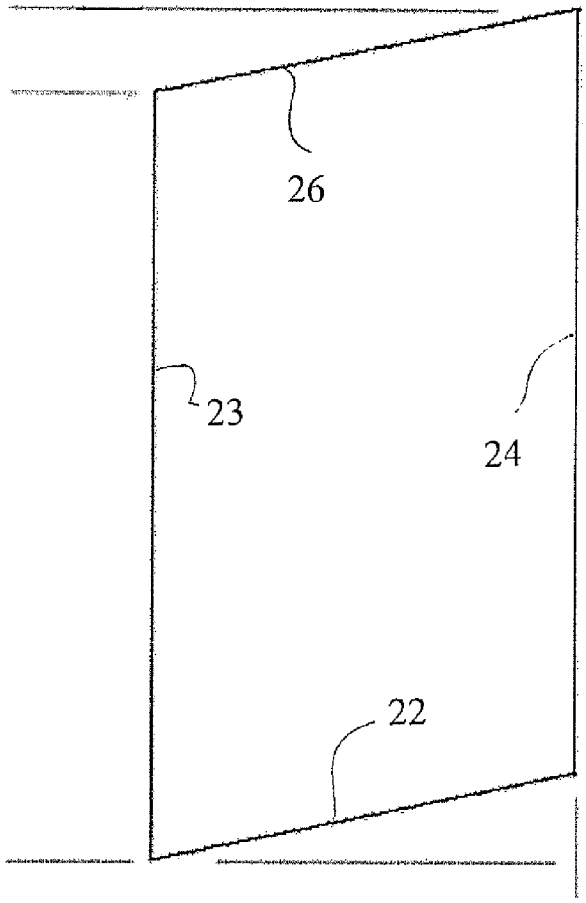

In FIGS. 3, 4 and 5 is shown a set of containers 20 comprising a plurality of containers 21 each having a base 22 for resting on the shelf 11, upstanding front 23 and rear 24 walls and upstanding side walls 25. The front, rear and side walls of the containers define a common width and depth of the containers so that they can be arranged in rows located side by side across the width of the shelf with a plurality of containers in each row from the front edge 11A to the rear edge 11B.

The containers 21 have the front and rear walls 23, 24 inclined at a wall angle A to a plane P at right angles to the base 22, which wall angle A is substantially equal to the shelf angle B so that with the base sitting on the inclined shelf the front and rear walls 23, 24 stand substantially upright.

As shown in FIG. 3, each container has a top 26 which is substantially parallel to the base 22.

As shown in FIGS. 3 and 4, the front and rear walls 23, 24 are planar and parallel and the side walls 25 are planar and parallel so that the containers are substantially rectangular. These containers are typically formed of a board material. The front wall includes a square opening 27 covered by a transparent material 28 to allow viewing of the contents.

Figure 6B:
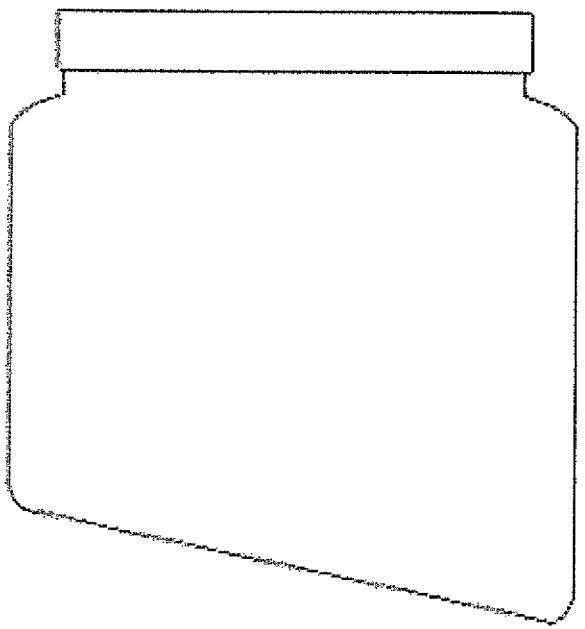
FIGS. 6A and 6B are respectively front and side views of the modified product container jars for use with the shelf of FIG. 3 or FIG. 5.
Figure 6A:
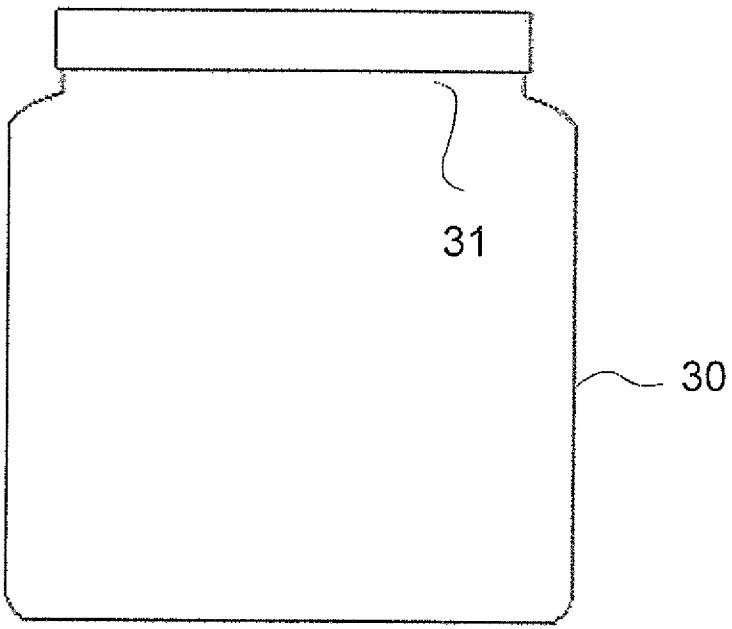

In an alternative arrangement shown in FIG. 6, the wails are molded from a transparent material 30 to form a jar where the molded top 31 forms an opening 32 with a covering lid 33 with a peripheral rim 34 which is a snap fit or a screw fit onto a rib at the opening 32.

As shown in FIGS. 7A to 7D, wherein the lid 33 has an opening 35 therein smaller than the opening 32 in the top with a hinged opening portion 36 which snaps by a snap edge 37 shut on the lid to close the opening in the lid. As shown as an example, the lid 33 is circular and the opening is 35 semicircular so as to form less than half of the open top 32.

The opening portion 36 carries protruding clips 38 to hold a sample 39 of the contents of the container against the underside of the opening portion 36. The clips are arranged in two spaced pairs 40, 41 to hold the elongate sample 39 clipped between each pair and extending longitudinally between the pairs.

Figure 7:
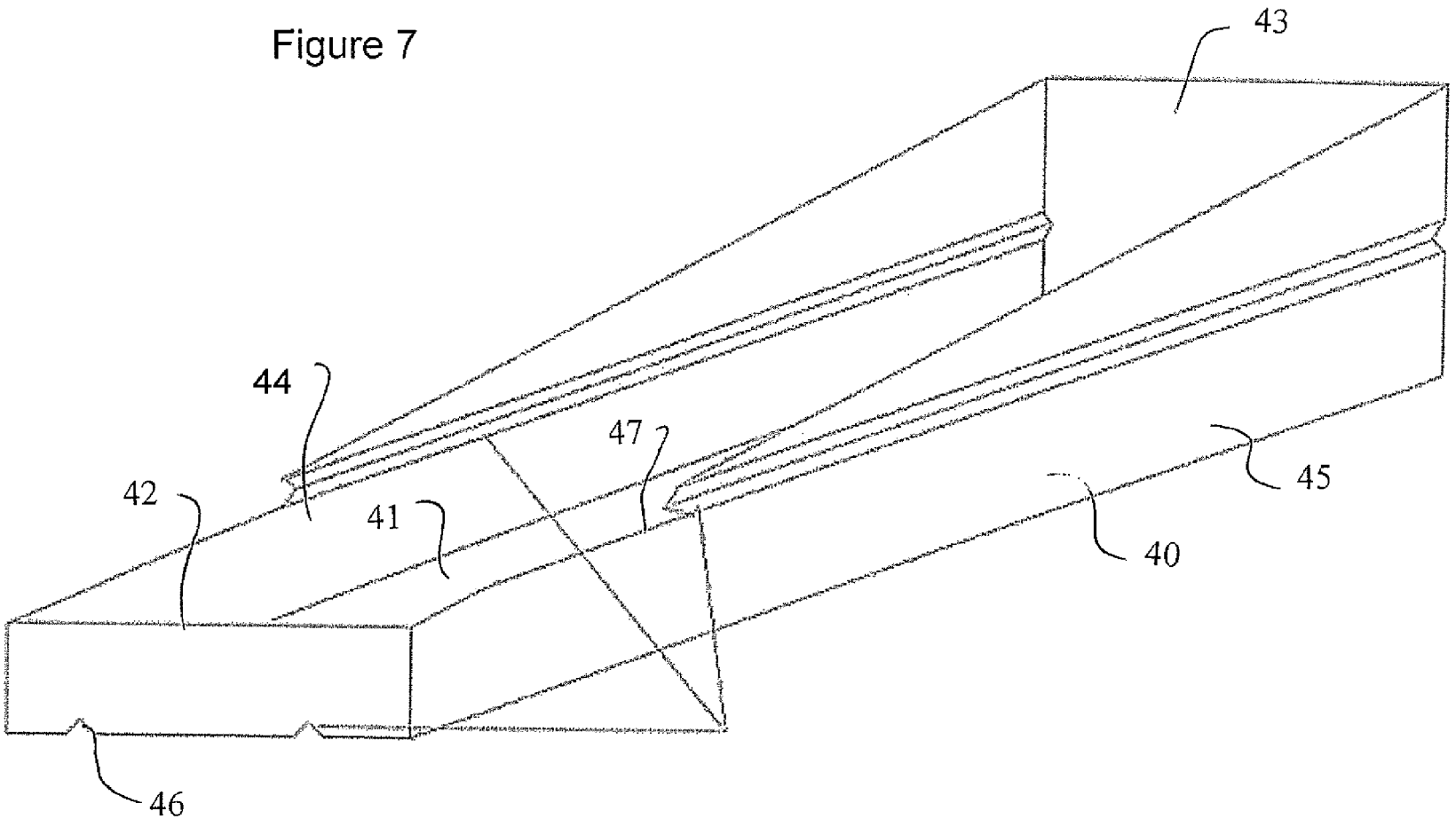
FIG. 7 is an isometric view of one tray of FIG. 5.
Figure 7A:
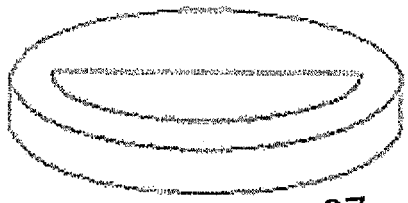
FIGS. 7A and 7B are isometric views of a lid of the modified product container jars of FIGS. 6A and 6B in open and closed positions respectively.
Figure 7B:
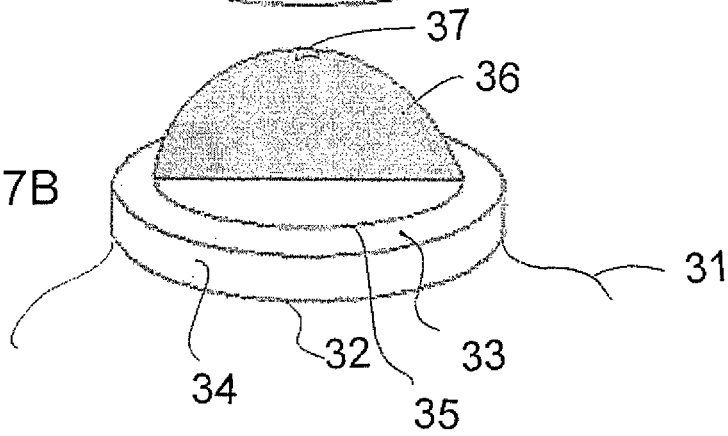
Figure 7C:
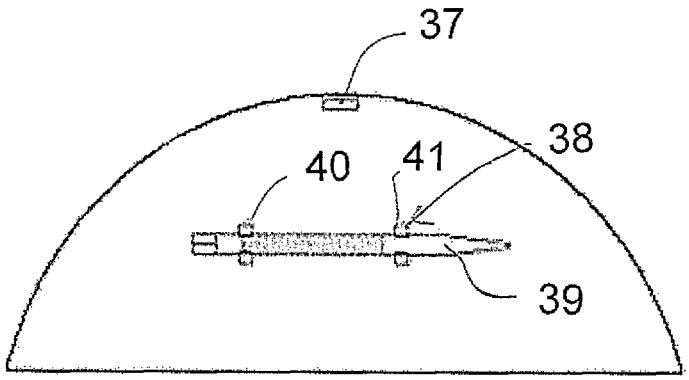
Figure 7D:
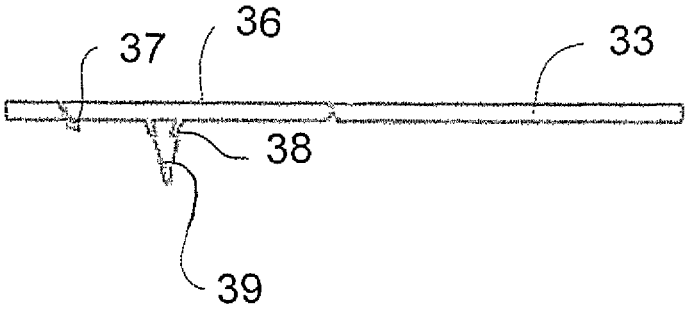

As shown in FIGS. 5 and 7, there is provided a tray 40 with a flat base 41 arranged to sit on the shelf 11 with front and rear walls 42, 43 upstanding from the base with side walls 44, 45. The tray has a width substantially equal to the width of the containers 21 for receiving one row of the containers.

The tray includes a removable cover portion (note shown) attached to a top edge 47 or wrapped over the tray for retaining the containers 21 on the tray and protecting the containers for shipping. The cover portion is removable by tearing or unwrapping to allow the tray containing the containers to be placed on the shelf for display of the containers. This allows the containers to be easily loaded and also improves the sliding action in the inclined shelf. For further improvement, the side walls 44, 45 and the base 41 can include notches 46 forming narrow rails on which the containers slide. The tray can be used with conventional articles or containers to hold the row of articles or containers to be displayed for sale. For improved sliding action, the tray has at least the base thereof formed from a plastics material having a coefficient of friction less than that of the shelf.

The arrangement described in more detail hereinafter also provides lids for the jars which are provided with openings to allow easy removal of contained product without removing the lid from the container. The opening provided may encompass one half or more of the top surface area of the lid. The opening portion of the lid is provided with four or more protrusions to form "clips" in order to hold a tool to set or imbed the product when the product is one such as finishing nails. The protrusions may also hold a tool known as a "driver bit" when the product held by the container is a type of screw which uses a tool to apply it. The lid, when in a closed position, is retained by one or more protrusions forming a latch which are in frictional contact with the main body of the lid.

Figure 3A:
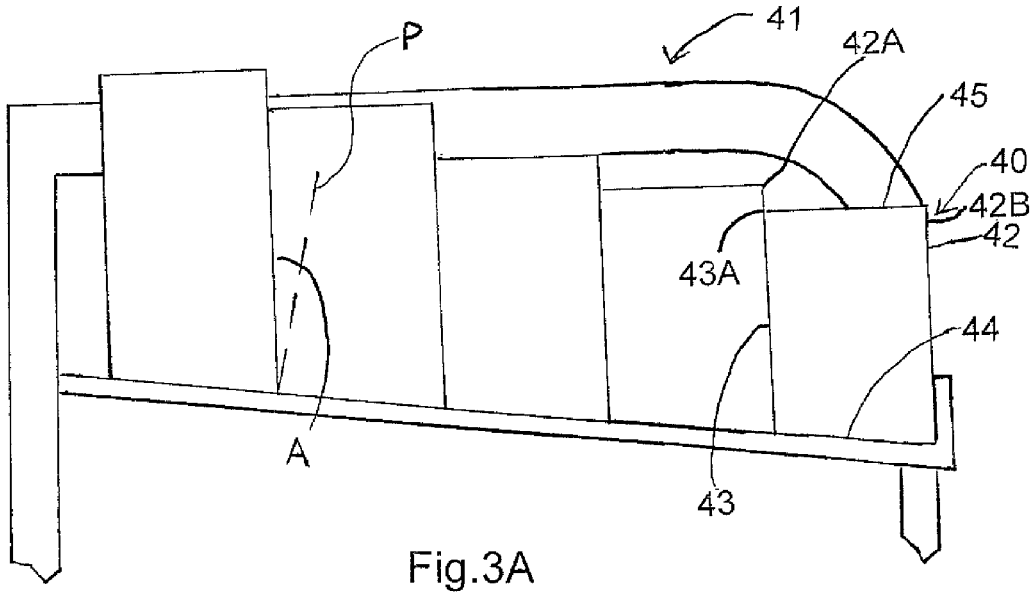
FIG. 3A is a side elevational view of the same conventional shelf of the rack of FIG. 1 with modified product container boxes according to the present invention placed on it.

In FIG. 3A is a side elevational view of the same conventional shelf of the rack of FIG. 1 with a second embodiment of the modified product container boxes according to the present invention placed on it. In this arrangement, each container 40 of the row 41 of containers on the inclined shelf has a front wall 42, a rear wall 43, a bottom wall 44 and a top wall 45 where the front wall 42 extends from the base to a top edge 42A which is higher than a top edge 43A of the rear wall 43 thereof. In this way the bottom wall 44 lies flat on the shelf at the shelf angle and the front and rear walls stand vertically upwardly to the top wall 45 which is horizontal.

Figure 3B:
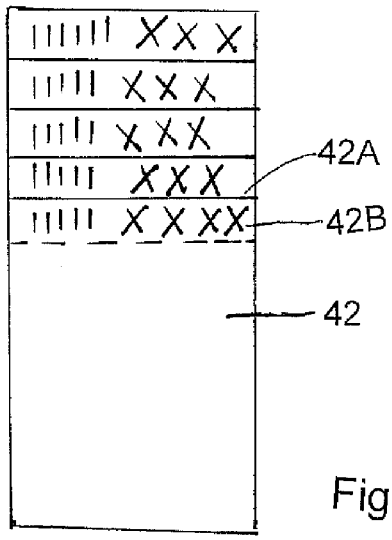
FIG. 3B is a front elevational view of the row of containers of FIG. 3A showing the row of front strip portions exposed at the front face of the row.

In this way, a portion 42B of the front wall at the top edge 42A of the front wall is exposed above the top edge 43A of the rear wall of the next adjacent container of the row. In the situation where the containers are basically rectangular and the edges straight, this causes the exposed portion to form a strip across the top edge. As shown in FIG. 3B, which is a front elevational view of the row of containers of FIG. 3A showing the row of front strip portions exposed at the front face of the row, each container of the row has the portion 42B thereof exposed. Thus, when viewed in front elevation, the portions 42B of the containers of the row are visible each behind the next.

The portions of the containers of the row contain product data 42X printed thereon which preferably includes a machine readable code 42Y.

In this arrangement, each container has a top wall which is inclined to the bottom wall at an angle substantially equal to the shelf angle so as to be substantially horizontal in position on the rack.

The invention claimed is:

1. Apparatus comprising:

a display rack with a planar shelf surface which is inclined at a shelf angle from a front edge upwardly and rearwardly to a rear edge so that articles on the planar shelf surface tend to slide forwardly to the front edge, and a set of containers each container comprising:

a base sitting on the planar shelf surface;

an upstanding front wall;

an upstanding rear wall;

a top wall;

and two upstanding side walls;

the containers of the set being arranged in a row with each container immediately in front of a next container behind:

so that the rear wall of said each container is butting the front wall of the next container behind;

and so that a forwardmost one of the containers has the front wall thereof located at the front edge of the shelf surface;

the front and rear walls of the containers defining therebetween a common width of the containers and the side walls of the containers defining therebetween a common depth of the containers;

the containers having the front and rear walls thereof inclined at a wall angle to a plane at right angles to the base, which wall angle is substantially equal to the shelf angle so that, with the base sitting on the inclined planar shelf surface, the front and rear walls stand substantially upright;

the top wall of each container being inclined to the base at an angle substantially equal to the shelf angle;

so that the rear wall of said each container is of less height from the planar shelf surface than the front wall of said next container behind;

so that, for each container of the row, a strip portion at the top edge of the front wall of said next container behind is exposed above the top edge of the rear wall of said each container;

and so that, when viewed in front elevation, the strip portion of the front wall of each container in the row is visible.

2. The apparatus according to claim 1 wherein the strip portion of the front wall of the containers of the row contains product data printed thereon.

3. The apparatus according to claim 1 wherein the strip portion of the front wall of the containers of the row contains machine readable data printed thereon identifying the container.

4. The apparatus according to claim 1 further comprising a tray with a flat base arranged to sit on the shelf with front and rear walls upstanding from the base, the tray having a width substantially equal to the width of the containers for receiving one row of the containers.

5. The apparatus according to claim 4 wherein the tray includes a removable cover portion for retaining the containers on the tray and protecting the containers for shipping, the cover portion being removable to allow the tray containing the containers to be placed on the shelf for display of the containers.

6. The apparatus according to claim 4 wherein the tray has at least the base thereof formed from a plastics material having a coefficient of friction less than that of the shelf.

7. Apparatus comprising:

a display rack with a planar shelf surface which is inclined at a shelf angle from a front edge upwardly and rearwardly to a rear edge so that articles on the planar shelf surface tend to slide forwardly to the front edge, and a set of containers each container comprising:

a base sitting on the planar shelf surface;

an upstanding front wall;

an upstanding rear wall;

a top wall;

and two upstanding side walls;

the containers of the set being arranged in a row with each container immediately in front of a next container behind;

so that the rear wall of said each container is butting the front wall of the next container behind;

and so that a forwardmost one of the containers has the front wall thereof located at the front edge of the shelf surface;

the front and rear walls of the containers defining therebetween a common width of the containers and the side walls of the containers defining therebetween a common depth of the containers;

the containers having the front and rear walls thereof inclined at a wall angle to a plane at right angles to the base so that, with the base sitting on the inclined planar shelf surface, the front and rear walls stand substantially upright;

the top wall of each container being inclined to the base at an angle so that the rear wall of said each container is of less height from the planar shelf surface than the front wall of said next container behind;

so that, for each container of the row, a strip portion at the top edge of the front wall of said next container behind is exposed above the top edge of the rear wall of said each container;

and so that, when viewed in front elevation, the strip portion of the front wall of each container in the row is visible.

8. The apparatus according to claim 7 wherein the strip portion of the front wall of the containers of the row contains product data printed thereon.

9. The apparatus according to claim 7 wherein the strip portion of the front wall of the containers of the row contains machine readable data printed thereon identifying the container.

10. The apparatus according to claim 7 further comprising a tray with a flat base arranged to sit on the shelf with front and rear walls upstanding from the base, the tray having a width substantially equal to the width of the containers for receiving one row of the containers.

11. The apparatus according to claim 10 wherein the tray includes a removable cover portion for retaining the containers on the tray and protecting the containers for shipping, the cover portion being removable to allow the tray containing the containers to be placed on the shelf for display of the containers.

12. The apparatus according to claim 10 wherein the tray has at least the base thereof formed from a plastics material having a coefficient of friction less than that of the shelf.

13. Apparatus comprising:

a display rack with a planar shelf surface which is inclined at a shelf angle from a front edge upwardly and rearwardly to a rear edge so that articles on the planar shelf surface tend to slide forwardly to the front edge, and a set of containers each container comprising:

a base sitting on the planar shelf surface;

an upstanding front wall;

an upstanding rear wall;

a top wall;

and two upstanding side walls;

the containers of the set being arranged in a row with each container immediately in front of a next container behind;

so that the rear wall of said each container is butting the front wall of the next container behind;

and so that a forwardmost one of the containers has the front wall thereof located at the front edge of the shelf surface;

the front and rear walls of the containers defining therebetween a common width of the containers and the side walls of the containers defining therebetween a common depth of the containers;

the top wall of each container being inclined to the base at an angle so that the rear wall of said each container is of less height from the planar shelf surface than the front wall of said next container behind;

the containers having the front and rear walls thereof inclined at a wall angle to a plane at right angles to the base thereof, which wall angle is equal to the shelf angle so that, with the base sitting on the inclined planar shelf surface, the front and rear walls stand vertically upwardly.

14. The apparatus according to claim 13 wherein the strip portion of the front wall of the containers of the row contains product data printed thereon.

15. The apparatus according to claim 13 wherein the strip portion of the front wall of the containers of the row contains machine readable data printed thereon identifying the container.

16. The apparatus according to claim 13 further comprising a tray with a flat base arranged to sit on the shelf with front and rear walls upstanding from the base, the tray having a width substantially equal to the width of the containers for receiving one row of the containers.

17. The apparatus according to claim 16 wherein the tray includes a removable cover portion for retaining the containers on the tray and protecting the containers for shipping, the cover portion being removable to allow the tray containing the containers to be placed on the shelf for display of the containers.

18. The apparatus according to claim 16 wherein the tray has at least the base thereof formed from a plastics material having a coefficient of friction less than that of the shelf.

* * * * *